US009820514B2

(12) United States Patent
Nykoluk

(10) Patent No.: US 9,820,514 B2
(45) Date of Patent: Nov. 21, 2017

(54) GARMENT WITH CARRYING SYSTEM

(71) Applicant: 5.11, Inc., Irvine, CA (US)

(72) Inventor: Cory Owen Nykoluk, Orange, CA (US)

(73) Assignee: 5.11, INC., Irvine, CA (US)

( * ) Notice: Subject to any disclaimer, the term of this patent is extended or adjusted under 35 U.S.C. 154(b) by 607 days.

(21) Appl. No.: 14/094,583

(22) Filed: Dec. 2, 2013

(65) Prior Publication Data

US 2014/0150161 A1 Jun. 5, 2014

Related U.S. Application Data

(60) Provisional application No. 61/732,165, filed on Nov. 30, 2012.

(51) Int. Cl.
*A41D 13/00* (2006.01)

(52) U.S. Cl.
CPC . *A41D 13/0007* (2013.01); *Y10T 428/249921* (2015.04)

(58) Field of Classification Search
CPC ..... A41D 13/0007; A41D 31/0055; Y10T 428/249921; F41H 1/00
USPC ..... 2/102, 2.5, 81
See application file for complete search history.

(56) References Cited

U.S. PATENT DOCUMENTS 478,076 A * 7/1892 Asten ..... A41F 15/002 2/323
1,495,489 A 5/1924 Krause
2,517,615 A 8/1950 Edward et al.
3,000,119 A * 9/1961 Altman ..... A43C 11/00 24/3.2
3,452,362 A 7/1969 Barron et al.
3,754,284 A * 8/1973 Hartigan ..... A41D 13/1209 2/114
3,973,275 A 8/1976 Blauer
4,041,549 A 8/1977 Atkinson
4,079,464 A 3/1978 Roggin
4,211,218 A 7/1980 Kendrick
4,266,297 A 5/1981 Atkins
4,422,454 A 12/1983 English
4,485,491 A 12/1984 Rasmussen
4,507,802 A 4/1985 Small
4,535,478 A 8/1985 Zufle
4,593,788 A 6/1986 Miller
(Continued)

FOREIGN PATENT DOCUMENTS

EP 2476327 A2 * 7/2012 ..... A41D 13/0007
WO 0048480 8/2000
(Continued)

*Primary Examiner* — Alissa L Hoey
(74) *Attorney, Agent, or Firm* — Kilpatrick Townsend & Stockton LLP

(57) ABSTRACT

A load-bearing garment, such as a vest, is provided having stretchable web platform on an outside surface, such as between front and back panels of the vest. The stretchable web platform includes stretchable bands that extend horizontally, and vertical webbing extending between multiple horizontal bands. Additional embodiments are directed to a mounting system in a plate carrier for a plate. Still further embodiments are directed to a handle and strap system for a vest or other garment that permits a quick rescue of a person wearing the vest.

18 Claims, 6 Drawing Sheets

(56) References Cited

U.S. PATENT DOCUMENTS 4,745,883 A * 5/1988 Baggetta ..... A47D 13/086 119/770
5,027,833 A 7/1991 Calkin
5,060,314 A 10/1991 Lewis
5,072,453 A 12/1991 Widder
5,157,792 A 10/1992 Allen et al.
5,220,976 A 6/1993 Gunter
5,325,538 A 7/1994 Schoenweiss et al.
5,327,811 A 7/1994 Price et al.
5,331,683 A 7/1994 Stone et al.
5,431,318 A 7/1995 Garcia
5,495,620 A 3/1996 Schoenweiss et al.
5,514,019 A * 5/1996 Smith ..... A41D 13/0007 2/311
5,531,292 A 7/1996 Bell
5,564,476 A * 10/1996 Golz ..... D03D 3/02 139/387 R
5,584,737 A 12/1996 Luhtala
5,617,582 A 4/1997 Burwell
5,644,792 A 7/1997 Tishler et al.
5,754,982 A 5/1998 Gainer
5,934,530 A 8/1999 Antezak et al.
5,974,585 A 11/1999 Bachner
6,041,444 A 3/2000 McKinney
6,108,816 A * 8/2000 Bradley ..... A62B 99/00 182/3
6,158,642 A 12/2000 Herbage
6,185,738 B1 2/2001 Sidebottom
6,213,365 B1 4/2001 Stocke et al.
6,233,740 B1 * 5/2001 Meyers ..... A41D 13/0007 2/102
6,659,689 B1 12/2003 Courtney et al.
6,712,251 B2 3/2004 Godshaw et al.
6,775,846 B1 * 8/2004 LaFauci ..... A41F 19/005 2/125
7,204,468 B2 * 4/2007 Kintzele ..... A47D 15/00 248/102
7,240,404 B2 7/2007 Flossner
7,264,023 B2 * 9/2007 Jackson ..... D03D 13/00 139/383 R
7,318,542 B2 1/2008 Godshaw et al.
7,424,748 B1 9/2008 Mcdunn et al.
7,444,686 B2 11/2008 Stewart
7,490,358 B1 * 2/2009 Beck ..... A41D 13/0531 2/102
7,536,728 B1 5/2009 Leathers
7,610,641 B2 11/2009 Frost
7,699,197 B2 4/2010 Panosian et al.
7,712,148 B2 5/2010 Carlson
7,748,053 B1 7/2010 Hancock
7,770,770 B2 8/2010 Murdoch et al.
7,810,167 B2 10/2010 Seitzinger et al.
7,845,527 B1 * 12/2010 McMillan ..... B26B 29/02 224/232
7,917,968 B2 4/2011 Roux
8,002,159 B2 8/2011 Cragg
8,011,545 B2 9/2011 Murdoch et al.
8,025,192 B2 9/2011 Petzel et al.
8,079,503 B1 * 12/2011 Yeates ..... A45C 7/0086 224/268
8,087,560 B2 1/2012 Crye
8,590,116 B2 * 11/2013 Dahl ..... D07B 1/18 24/300
8,608,041 B1 * 12/2013 Adkisson ..... A45F 5/00 2/102
8,635,714 B2 * 1/2014 Hazlett ..... F41H 1/02 2/2.5
9,114,749 B2 * 8/2015 Ashliman ..... B60P 7/0823
2003/0146348 A1 8/2003 Douglas et al.
2004/0023574 A1 2/2004 Calkin
2004/0027751 A1 2/2004 Goerke et al.
2005/0179244 A1 8/2005 Schroth
2006/0143763 A1 7/2006 Dawson et al.
2006/0253950 A1 11/2006 Kerr
2006/0288466 A1 12/2006 Bucheit
2007/0044197 A1 * 3/2007 Turcotte ..... A41D 13/0007 2/69
2007/0289045 A1 12/2007 Evans et al.
2008/0010730 A1 1/2008 Twito et al.
2009/0117300 A1 * 5/2009 Thompson ..... A45F 5/02 428/35.2
2009/0211000 A1 8/2009 Roux
2009/0282595 A1 11/2009 Branson et al.
2009/0307878 A1 12/2009 Kadas
2009/0320171 A1 12/2009 Kocher et al.
2010/0031415 A1 2/2010 Shadid
2010/0162459 A1 7/2010 Bronstein et al.
2010/0224660 A1 * 9/2010 Gleason ..... A45F 3/047 224/264
2010/0313329 A1 12/2010 Haynes
2011/0055992 A1 * 3/2011 Roux ..... F41H 1/02 2/2.5
2011/0191933 A1 * 8/2011 Gregory ..... A41D 13/0012 2/69
2012/0132065 A1 5/2012 Seuk
2012/0180189 A1 7/2012 Crye
2013/0126566 A1 * 5/2013 Seuk ..... A45F 5/00 224/223
2013/0240588 A1 * 9/2013 Milligan ..... A45F 3/047 224/580
2014/0090145 A1 * 4/2014 Strum ..... F41H 1/02 2/69
2014/0151424 A1 * 6/2014 Hexels ..... A45F 3/06 224/637
2014/0263519 A1 * 9/2014 Saucedo ..... A45F 3/08 224/633
2015/0157117 A1 * 6/2015 Seuk ..... A45F 3/02 224/182
2015/0257458 A1 * 9/2015 Nykoluk ..... A41D 1/04 2/102
2016/0044976 A1 2/2016 Nykoluk et al.

FOREIGN PATENT DOCUMENTS

WO 0205678 1/2002
WO 2005119162 12/2005
WO 2006134241 12/2006
WO 2007079387 7/2007
WO 2007146797 12/2007
WO 2008072011 6/2008
WO 2008073087 6/2008
WO 2009052769 4/2009

* cited by examiner

GARMENT WITH CARRYING SYSTEM

CROSS-REFERENCES TO RELATED APPLICATIONS

The present application claims the benefit of U.S. Provisional Application No. 61/732,165, filed on Nov. 30, 2012, the full disclosure of which is incorporated herein by reference.

BACKGROUND

MOLLE (Modular Lightweight Load-carrying Equipment) is load-bearing equipment and rucksacks utilized by the United States armed forces. The MOLLE system is modular and permits the attachment of various MOLLE-compatible accessories, such as holsters, magazine pouches, radio pouches, knife sheathes, and other gear to MOLLE compatible load-bearing garments, such as vests, backpacks, and jackets.

The MOLLE system's modularity is derived from the use web platforms on load-bearing garments. For example, PALS (Pouch Attachment Ladder System) web platforms can be included on the load-bearing garments. PALS webbing includes rows of heavy-duty nylon stitched onto the vest or other load-bearing garment so as to allow for attachment of MOLLE accessories.

PALS webbing is attached to load-bearing garments in a grid structure. The PALS grid consists of horizontal rows of 1 inch nylon webbing (most commercial vendors use Type IIIa), spaced 1 inch apart, and reattached, typically via stitching, to the backing at 1.5 inch intervals. This consistent reattachment forms, for each strap, a series of upwardly and downwardly opened loops. The loops for adjacent straps are aligned so that a series of loops are stacked one on top of each other. This pattern provides secure and stable attachment for MOLLE accessories.

The following references may be relevant to this technology: U.S. Published Patent application number 2012/0180189 and U.S. Pat. No. 7,917,968.

BRIEF SUMMARY

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

In accordance with embodiments, a load-bearing garment, such as a vest, is provided having stretchable web platform on an outside surface, such as between front and back panels of the vest. The stretchable web platform includes stretchable bands that extend horizontally, and vertical webbing extending between multiple horizontal bands.

The stretchable bands can be, for example, elastic sleeves that fit within tube webbing, and pull the tube webbing inward.

Gear can be attached either to the horizontal bands or the vertical webbing. The gear can be, for example, MOLLE compatible gear.

Additional embodiments are directed to a mounting system in a plate carrier for a plate. The mounting system includes two sets of straps, such as webbing, with hook and loop material. The straps can be connected at different points along their length so that plates of various sizes can be accommodated. For each set, one strap extends under the plate and one strap extends around a lower side edge of the plate. The ends are connected by the hook and loop materials. Pulling the ends taunt permits the plate to be firmly held in position, regardless of plate size.

Still further embodiments are directed to a handle and strap system for a vest or other garment that permits a quick rescue of a person wearing the vest. A handle is attached to a strap and is usually accessible from an outside of the vest, for example just below the back of the base of the neck. The strap can be mounted in a pocket or sleeve in this storage configuration. The handle can be grasped and pulled outward, released for example from hook and loop closures. The strap is pulled outward, but is anchored at a distal end to the vest.

When the handle is pulled out and the strap is pulled taut, the handle can be used to pull and/or drag the wearer of the vest to a safe location. Once used, the strap can be stored again in its sleeve, and the handle can be reattached, if attachments are provided.

For a fuller understanding of the nature and advantages of the present invention, reference should be made to the ensuing detailed description and accompanying drawings.

BRIEF DESCRIPTION OF THE DRAWINGS

Various embodiments in accordance with the present disclosure will be described with reference to the drawings, in which.

DETAILED DESCRIPTION

In the following description, various embodiments of the present invention will be described. For purposes of explanation, specific configurations and details are set forth in order to provide a thorough understanding of the embodiments. However, it will also be apparent to one skilled in the art that the present invention may be practiced without the specific details. Furthermore, well-known features may be omitted or simplified in order not to obscure the embodiment being described.

In accordance with embodiments, a jacket or vest or other garment is provided having a stretchable web platform exposed for the attachment of gear, such as MOLLE compatible gear. In embodiments, the stretchable web platform can support gear hung either vertically or horizontally.

Figure 1:
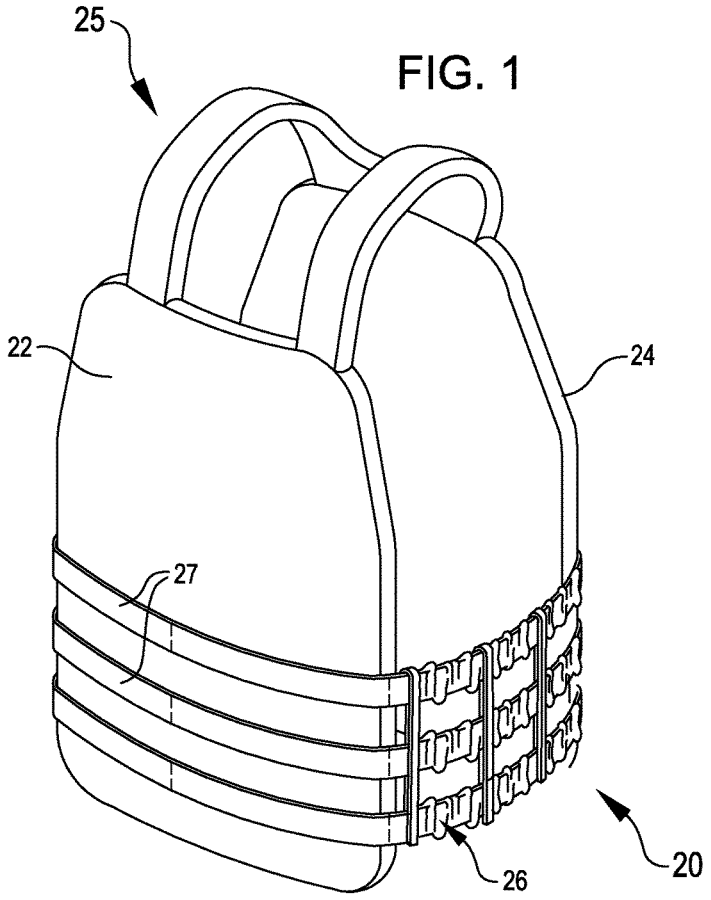
FIG. 1 is a side, perspective view of a vest incorporating stretchable web platform in accordance with embodiments.

For example, in the embodiment shown in FIG. 1, a vest 20 is shown having a front panel 22 and a rear panel 24. A shoulder yoke 25 attaches to the tops of the front and rear panels 22, 24 and connects the two panels. A stretchable web platform 26 extends between a bottom portion of the front panel 22 and the rear panel 24. Specifically, in FIG. 1, the stretchable web platform 26 extends between lower side edges of the front and rear panels. A separate stretchable web platform 26 is positioned on each side of the vest 20, although only the left side is shown in FIG. 1. Webbing material 27 extends from the stretchable web platform 26 and across the front the front panel 22 and the rear (not shown) of the rear panel 24. Thus, the stretchable web platform 26 on each side of the vest 20 and the webbing material 27 on the front and rear panels 22, 24 circumscribe the bottom of the vest. The stretchable web platform 26 permits some elasticity to the connection between the front and rear panels 22, 24, providing a more snug fit of the vest without the vest being too tight.

Although shown as attached between the front and rear panels 22, 24, the stretchable web platform 26 can be attached to other locations, such as across the front or inside either of the panels 22, 24 of the vest 20. To this end, the stretchable web platform 26 can extend over any portion of the outside of the vest 20, or can overlap portions of the inside of the vest. The stretchable web platform 26 can also be mounted on other garments, such as a jacket or pants, or could be used with many different items, including backpacks. The stretchable web platform has particular application, however, to installations where both (1) stretch and elasticity and (2) attachment of gear are desired at the same location.

Figure 2:
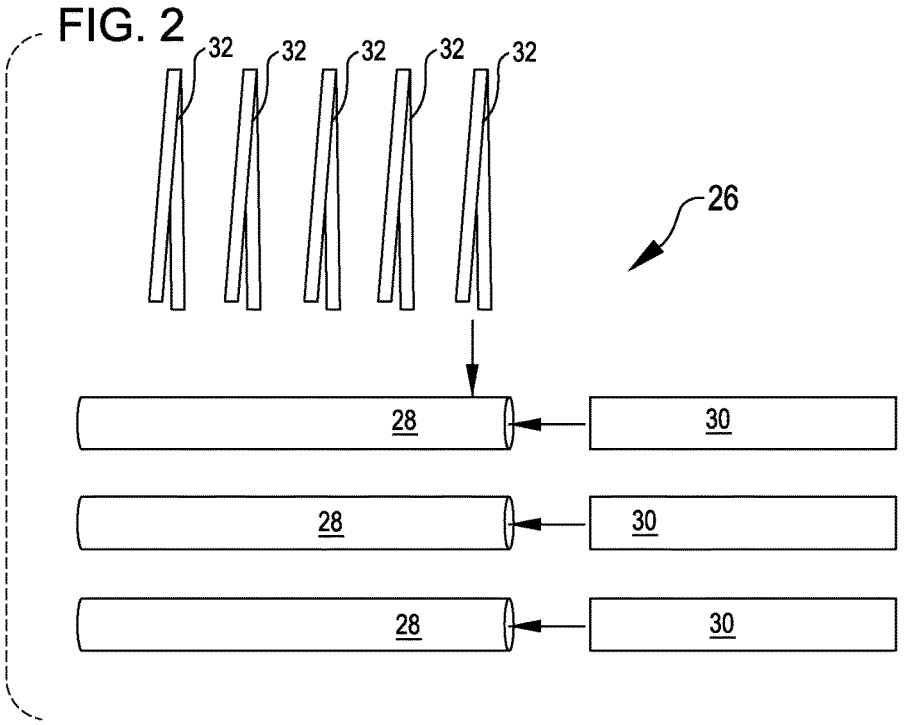
FIG. 2 is an exploded perspective view of stretchable web platform in accordance with embodiments.

Details of the stretchable web platform 26 are shown in the exploded perspective view of FIG. 2. The stretchable web platform 26 includes a plurality (e.g., more than two) horizontally-aligned webbing tubes 28. The webbing tubes 28 can be, for example, 1.0 inch tubes of webbing.

Strips 30 of elastic material are inserted in the webbing tubes 28. The elastic strips 30 can be elastic webbing or other material that is stretchable and has a memory to return to its initial shape after stretching. The elastic can be made of rubber or an imitative rubber synthetic material, as examples.

Figure 3:
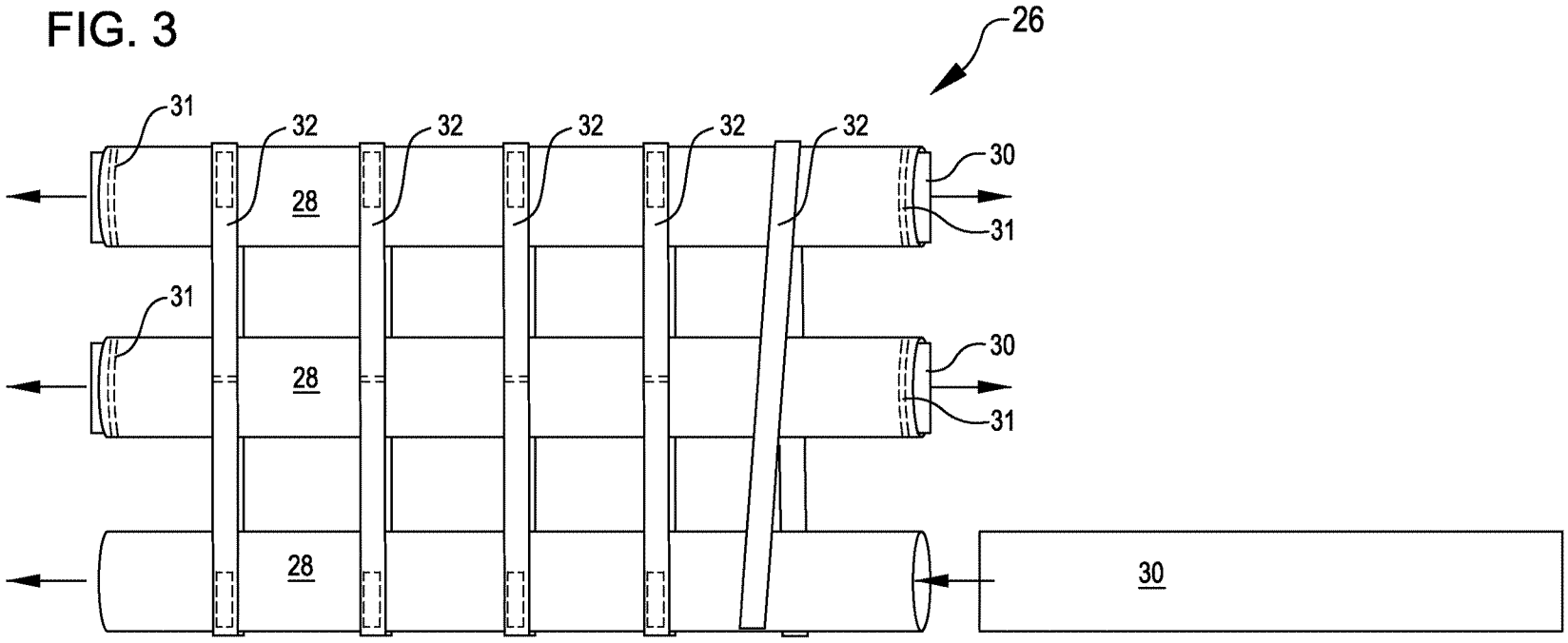
FIG. 3 is a side assembled view of the stretchable web platform of FIG. 2.

The elastic strips 30 are shorter in length than the webbing tubes 28. In embodiments, the elastic strips 30 are ⅔ the length of the webbing tubes 28. For example, the elastic strip 30 may be approximately ⅔ of an uncompressed length of the webbing tube 28 when the elastic strip 30 is not in tension. As shown in FIG. 3, the ends of the elastic strips 30 are sewn at sew lines 31 to ends of the webbing tubes 28. Sewing the elastic strips 30 to the ends of the webbing tubes 28 causes the webbing tubes to compress and fold to the length of the elastic straps. The webbing tubes 28 can include a number of folds or wrinkles during this compression.

The compressed webbing tubes 28 and the elastic strips 30, once sewn together, provide a stable structure to which gear, such as MOLLE compatible gear, can be attached. The outer webbing tubes 28 provide a surface that is similar to regular webbing, and thus is suitable for the attachment of gear. The compressed/folded/wrinkled configuration of the web tubing 28, along with the elastic strips 30, permits the overall structure of the stretchable web platform 26 to be stretchable in a horizontal direction, allowing the vest 20 to fit snugly, but not too tightly, against a wearer, and to adjust to movements of a wearer, adding to comfort to the wearer.

Vertical webbing 32 (FIG. 2) can be attached between multiple webbing tubes 28. The vertical webbing 32 can be any width, but in embodiments is 0.25 inch webbing. In some embodiments, respective vertical webbing 32 may be folded over (e.g. FIG. 2) and arranged so that a first portion and second portion thereof are positioned on opposite sides (e.g., front and back in FIG. 3) of the web tubing 28. The vertical webbing 32 is sewn to the web tubing 28, and can also be sewn through the web tubing to the elastic; snips 30. In embodiments, however, the vertical webbing 32 is sewn only to the web tubing 28, allowing the elastic strips 30 to freely move within the web tubing 28.

Figure 4:
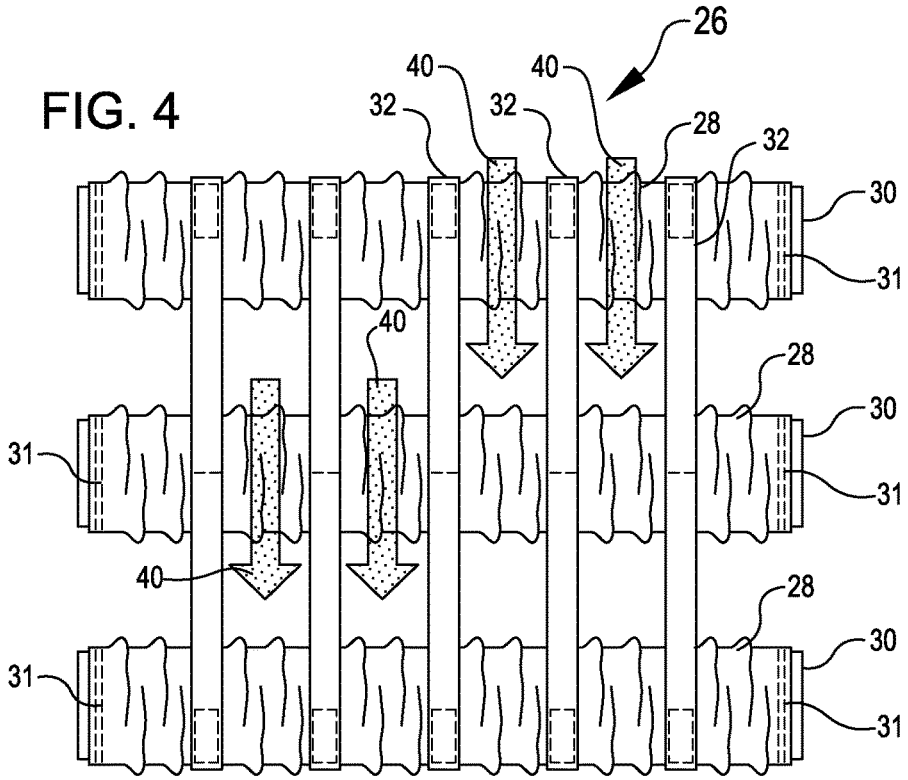
FIG. 4 is a side view, similar to FIG. 3, of the stretchable web platform of FIG. 2, showing vertical mount options for the stretchable web platform.

As shown in FIG. 4, the stretchable web platform 26 can receive and support gear, such as MOLLE compatible gear, mounted vertically, as shown by the arrows 40. The gear mounts down over one or two of the horizontally aligned web tubings 28. The gear can attach, for example, between vertical webbings 32 or on opposite sides of a vertical webbing.

Figure 5:
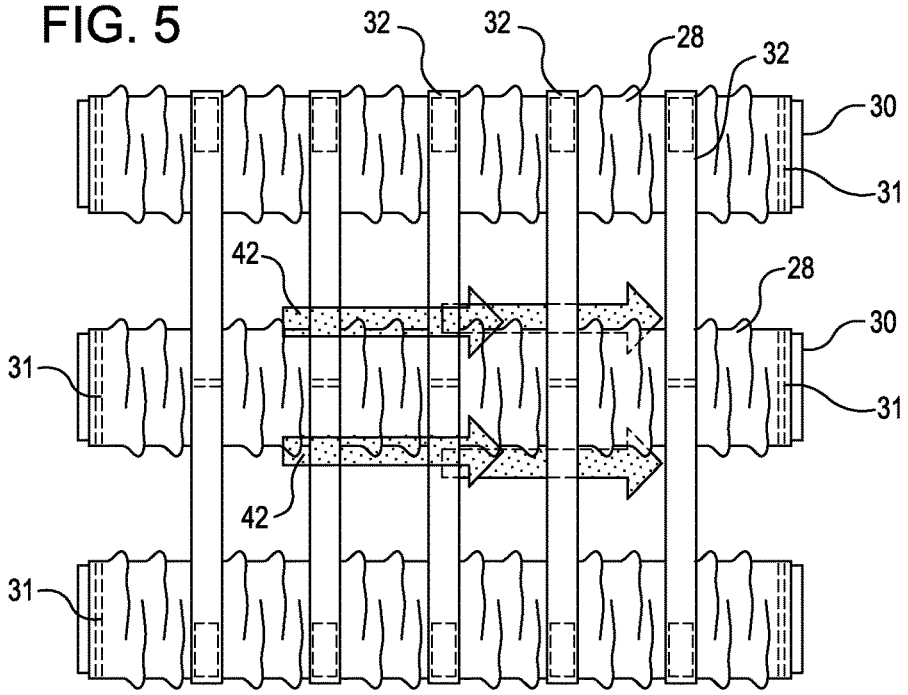
FIG. 5 is a side view, similar to FIG. 4, of the stretchable web platform of FIG. 2, showing horizontal mount options for the stretchable web platform.

As shown in FIG. 5, the stretchable web platform 26 can also receive and support gear, such as MOLLE compatible gear, mounted horizontally, as shown by the arrows 42. The gear mounts sideways, attached to one or more of the vertical webbings 32. The gear can attach, for example, between adjacent horizontally aligned web tubings 28 or on opposite sides of a horizontally aligned web tubing.

Figure 6:
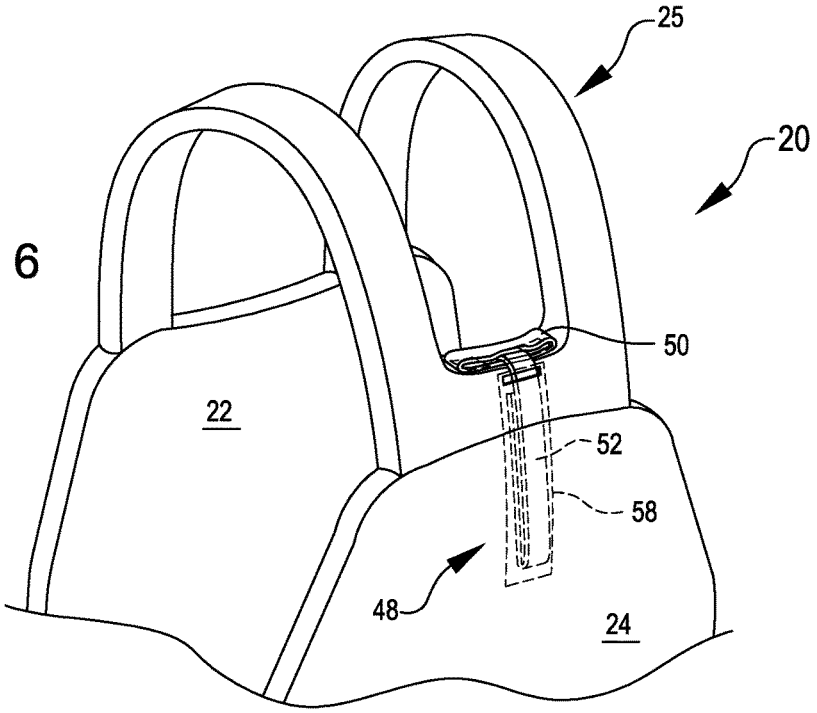
FIG. 6 is a perspective view of a plate carrier vest having a handle and strap system, with the system in a stored configuration.
Figure 7:
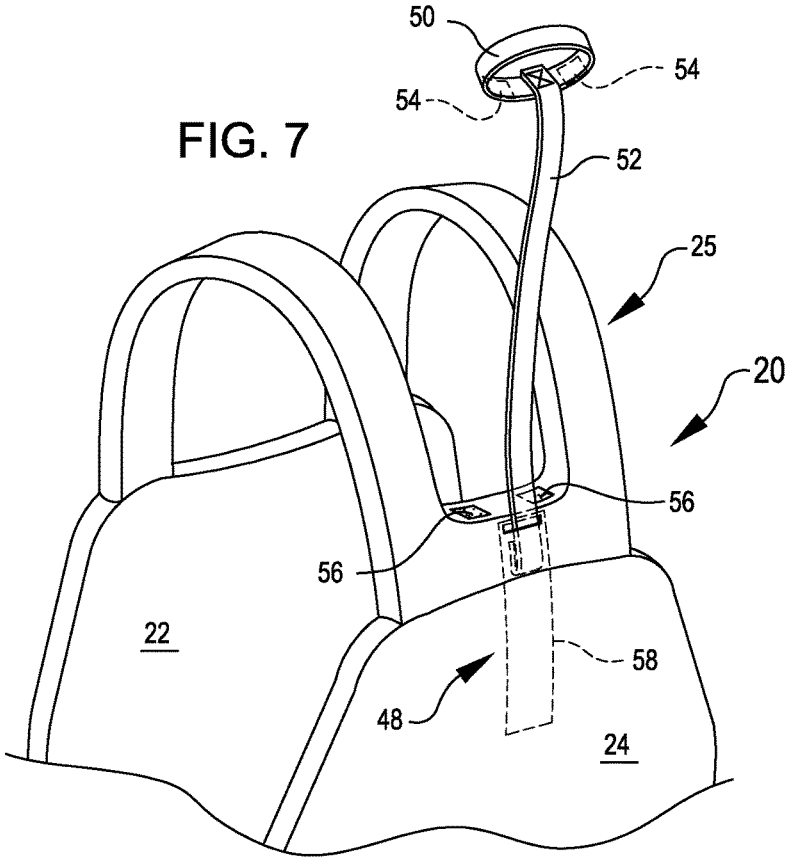
FIG. 7 is a perspective view, similar to FIG. 6, of the plate carrier vest with the handle and strap system in a deployed configuration.

FIG. 6 shows another feature that can be provided for the vest 20. In FIG. 6, a handle and strap system 48 is shown mounted on the rear of the vest 20. The handle and strap system 48 permits a quick rescue of a person wearing the vest or other garment. Briefly described, the handle and strap system 48 is mounted in a storage position against and/or within the vest 20 (FIG. 6), and can be pulled outward to a deployed position where it can be used to drag a wearer of the vest to a safe location (FIG. 7). A handle 50 is attached to a strap 52 and mounted in a storage configuration where the handle is accessible from an outside of the vest, for example just below the back of the base of the neck.

In the storage position, fasteners or other connectors, such as hook and loop closures 54, 56, can be used to hold the handle in position. Hook and loop closures 54, 56 work well to connect the handle, because the closures can be released and the handle and strap deployed using a single movement (i.e., pulling outward on the handle). However, other closures can be used, or the handle can be held in position by gravity and/or retention of the strap 52. Closures could also or alternatively be used to retain the strap.

In the embodiment shown in the drawing, the handle 50 is formed of a loop of webbing. The strap 52 is attached to one position on the loop, and the closures 54 are positioned on opposite sides of the strap attachment. The closures 54 connect to closures 56 when the handle is in the storage position.

In embodiments, the strap 52 is positioned in a sleeve 58 or other pocket while the handle and strap system 48 is in the storage configuration. The sleeve 58 permits the strap 52 to be out of the way while the handle and strap system 48 is in the storage position, but easily deployed when needed. The sleeve 58 shown in the drawings extends in a direction of deployment so that the sleeve does not hinder deployment. A distal end of the strap 52 is anchored to the vest 20, for example at the opening of the sleeve 58.

In use, when a wearer of the vest 20 is to be rescued, the wearer is extended in a prone position, and the rescuer grasps the handle and pulls outward in a direction, first releasing the hook and loop closures 54, 56, and then pulling the strap 52 from the sleeve 58. The strap 52 is pulled taut against its anchor at an opening of the sleeve 58, such as is shown in FIG. 7. Continued pulling on the handle 50 permits the rescuer to drag the wearer to safety. The vest 20 retains the wearer during this rescue, and the strap can readily take advantage of the fact that the wearer is fully connected.

Once used, the strap 52 can be stored again in its sleeve 58, and the handle 50 can be reattached via the hook and loop closures 54, 56.

Figure 8:
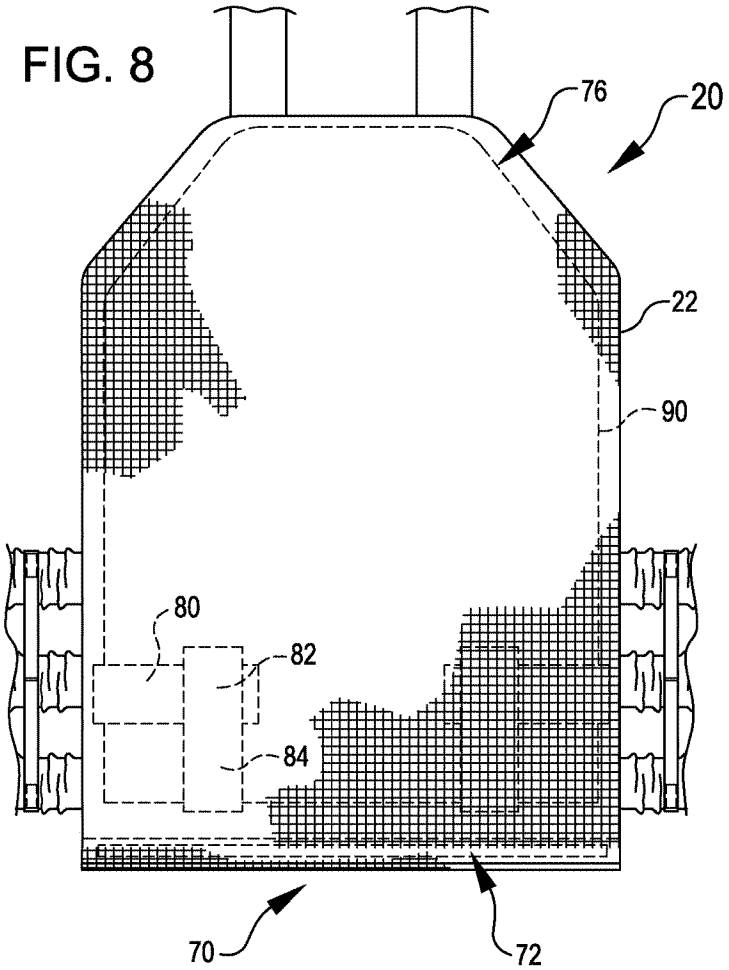
FIG. 8 is a rear view of a front panel of a plate carrier vest showing a plate carrier retention system in accordance with embodiments.

FIGS. 8-11 show a plate retention system 70 for a vest, such as the vest 20, in accordance with embodiments. The plate retention system 70 can be utilized, for example, in pockets on the front and/or back panels 22, 24 of the vest 20. Such pockets are known, and typically include an opening, such as an opening 72 at the bottom of the front panel 22 (FIG. 8). In the embodiment shown in the drawing, the opening 72 can include a closure 74, such as hook and loop closures, for easy access. The pocket is generally designated by the reference numeral 76, and is generally the inside region of a panel, such as the front panel 22, designed to receive a plate.

In use, a wearer can install a plate in one of the front and or back panels 22, 24. Such plates are known, and can be various sizes, depending upon the desire of the user and/or the needs for a particular assignment. In embodiments disclosed herein, the plate retention system 70 is configured to securely mount plates of different sizes and anchor and/or center a plate in place in the pocket 76.

In embodiments, the plate retention system 70 includes two sets of straps, one each at the lower bottom corners of the pocket 72. In short, these sets of straps include straps that are configured to extend around the bottom and sides of a plate inserted in the pocket and that attach to each other to push the plate to the center and top of the pocket 76. In this manner, the straps anchor the plate against the upper edge of the pocket, regardless of the size of the plate inserted. The straps can be any material, such as webbing, and include attachment mechanisms, such as hook and loop material, that permit attachment to each other at various locations along their length. Variable attachment locations permit anchoring of several different sizes of plates. The straps can be connected at different points along their length so that plates of various sizes can be accommodated. For each set, one strap extends under the plate and one strap extends around a bottom side edge of the plate. The ends are connected by the hook and loop materials to anchor the plate in the center of the pocket against the top of the pocket.

Specific embodiments are shown in FIGS. 8-11. A first strap 80 of each pair is positioned to extend horizontally, and is spaced from the bottom of the opening 72. The strap 80 is anchored at a first location 82 spaced inward from the side edge of the pocket and upward from a bottom edge of the pocket.

A second strap 84 of each pair is positioned to extend vertically, and is also anchored at a position spaced inward from the side edge of the pocket and upward from a bottom edge of the pocket. In embodiments, this second strap 84 is also and anchored at the first location 82.

In embodiments, the first strap 80 is positioned so that, if any size plate that would typically be installed in the front panel 22 were installed in the pocket of the front panel and pushed fully upward against the top of the pocket, the bottom edge of the plate would extend below a bottom edge of the first strap 80. The length of the first strap 80 is preferably sufficient so that, if the widest plate that fits into the pocket were installed, the strap could double back along its length while extending around the outer edge of the plate. Thus, the first location 82 would fall behind any size plate installed in the pocket 76.

The second strap 84 is positioned in a similar manner relative to the bottom and sides of the pocket 76. In an embodiment where the two straps are anchored at the same location 82, the two locations for the two sets of straps are positioned to be located behind any size plate to be received in the pocket after the plate has been centered and pushed to the top of the pocket.

Figure 9:
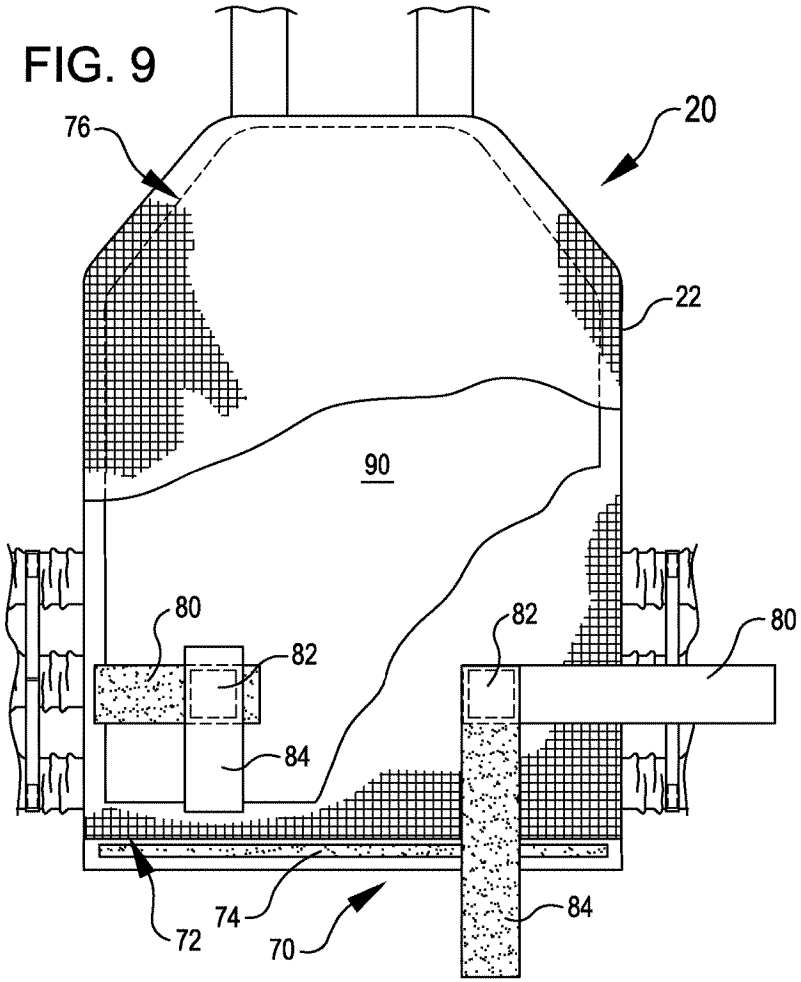
FIG. 9 is partial cutaway rear view of the front panel of the plate carrier vest of FIG. 8, with the plate carrier retention system partly detached.

To install a plate, such as the plate 90 shown in FIGS. 8 and 9, the fasteners 74 are opened at the bottom of the pocket 76 at the opening 72. The plate 90 is inserted into the pocket 76, centered in the pocket, and pressed upward against the top of the pocket. The ends of the two strap 80, 84 are wrapped around the side and bottom of the plate, respectively, and then attached to each other, for example via hook and loop fasteners extending along the length of the straps 80, 84. As an example, loop fastener material can be included on a front side of the strap 84, and hook fastener material on the rear side of the strap 80. The strap 80 is then folded over first, with the strap 84 attached to the strap 80. The straps 80, 84, if anchored at the same location 82, would be attached in the same vertical and horizontal position as the location 82 on the opposite side of the plate 90. If the straps are anchored at different locations, then the attachment would be varied based on the size of the plate.

Figure 11:
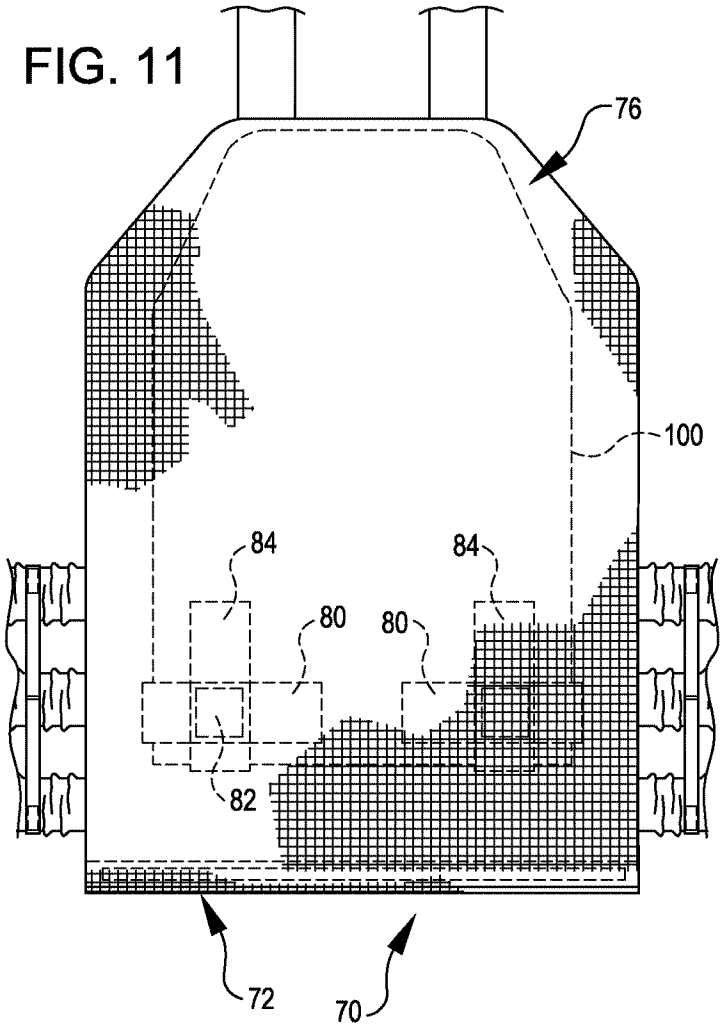
FIG. 11 is a rear view, similar to FIG. 8, with the plate of FIG. 10 mounted in the plate carrier vest.
Figure 10:
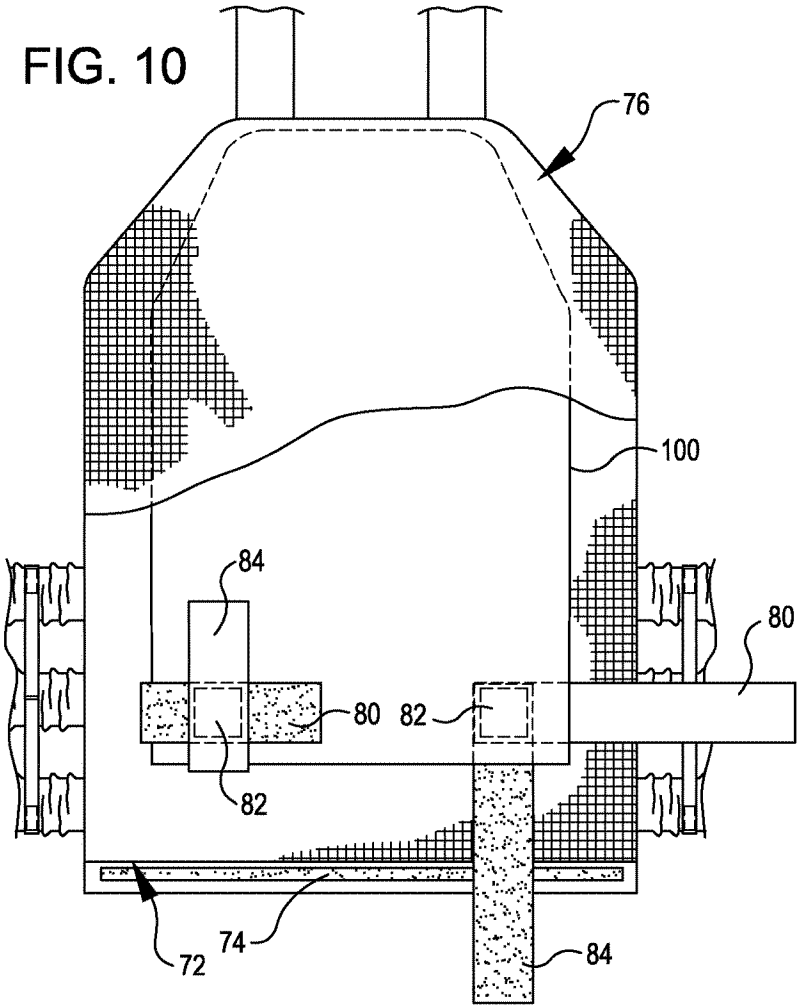
FIG. 10 is a partial cutaway rear view, similar to FIG. 9, with the plate carrier retention system partly attached around a smaller plate.

For a different size plate, such as the plate 100 shown in FIGS. 10-11, the straps are pulled more so as to appropriately anchor the plate. The system can thus be used on many different sized plates, and can be used to center the plate and position the plate upward. A plate could also be positioned to one side by varying the straps, for example to move the plate away from an injury. In addition, the plate does not have to be pushed to the top of the pocket, but instead could be held by gravity against the attached straps. Additionally, a similar strap configuration could be used at other locations in the pocket 76 (e.g., the top) to push the plate downward or in another desired direction.

Other variations are within the spirit of the present invention. Thus, while the invention is susceptible to various modifications and alternative constructions, certain illustrated embodiments thereof are shown in the drawings and have been described above in detail. It should be understood, however, that there is no intention to limit the invention to the specific form or forms disclosed, but on the contrary, the intention is to cover all modifications, alternative constructions, and equivalents falling within the spirit and scope of the invention, as defined in the appended claims.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

All references, including publications, patent applications, and patents, cited herein, including cited in the contemporaneously filed Information Disclosure Statement, are hereby incorporated by reference to the same extent as if each reference were individually and specifically indicated to be incorporated by reference and were set forth in its entirety herein.

What is claimed is:

1. A vest, comprising:

a front panel;

a rear panel;

a shoulder yoke attached to the front panel and the rear panel; and a stretchable web platform extending between the front panel and the rear panel, the stretchable web platform comprising:

at least two stretchable first webbing structures aligned along a first direction, each of said stretchable first webbing structures attached to both the front panel and the rear panel and comprising a webbing tube attached at each end of the webbing tube to an elastic strip to compress the webbing tube when the elastic strip is not in tension; and at least one second webbing structure aligned along a second direction transverse to the first direction and connecting at least two of said stretchable first webbing structures; wherein at least one of said at least one second webbing structure is (a) sewn to a respective stretchable first webbing structure of said at least two stretchable first webbing structures by stitching that extends through the webbing tube and the elastic strip of the respective stretchable first webbing structure, and (b) folded over to form a first portion and a second portion arranged on opposite sides of the respective stretchable first webbing structure.

2. The vest of claim 1, wherein the elastic strip is approximately ⅔ of an uncompressed length of the webbing tube when the elastic strip is not in tension.

3. The vest of claim 1, wherein the vest comprises three or more stretchable first webbing structures and two or more second webbing structures and wherein the stretchable first webbing structures and the second webbing structures form a grid.

4. The vest of claim 3, wherein the grid is configured to receive MOLLE gear attached to the stretchable first webbing structures.

5. The vest of claim 4, wherein the grid is configured to receive MOLLE gear attached to the second webbing structures.

6. The vest of claim 3, wherein the grid is configured to receive MOLLE gear attached to the second webbing structures.

7. The vest of claim 1, wherein at least one of said at least one second webbing structure is sewn to a particular stretchable first webbing structure of said at least two stretchable first webbing structures by stitching that extends through the webbing tube of the particular stretchable first webbing structure without extending through the elastic strip of the particular stretchable first webbing structure.

8. The vest of claim 1, further comprising a handle and strap system that permits pulling of a wearer of the vest by a handle.

9. The vest of claim 1, wherein the handle and strap system comprises:

a strap anchored to the vest; and the handle, wherein the handle is located at the end of the strap;

wherein the strap and the handle are configurable between (1) a storage configuration where the handle is anchored on the vest and the strap is received in a sleeve or a pocket of the vest and (2) a deployed configuration where the handle is pulled away from the vest and the strap is at least mostly pulled out of the sleeve so as to be configured for a rescuer to pull the handle to drag a wearer of the vest.

10. A vest, comprising:

a front panel;

a rear panel;

a shoulder yoke attached to the front panel and the rear panel; and a stretchable web platform extending between the front panel and the rear panel, the stretchable web platform comprising:

at least two stretchable first webbing structures aligned along a first direction, each of said stretchable first webbing structures attached to both the front panel and the rear panel and comprising a webbing tube attached at each end of the webbing tube to an elastic strip to compress the webbing tube when the elastic strip is not in tension; and at least one second webbing structure aligned along a second direction transverse to the first direction and connecting at least two of said stretchable first webbing structures; wherein at least one of said at least one second webbing structure is (a) sewn to a particular stretchable first webbing structure of said at least two stretchable first webbing structures by stitching that extends through the webbing tube of the particular stretchable first webbing structure without extending through the elastic strip of the particular stretchable first webbing structure, and (b) folded over to form a first portion and a second portion arranged on opposite sides of the particular stretchable first webbing structure.

11. The vest of claim 10, wherein the elastic strip is approximately ⅔ of an uncompressed length of the webbing tube when the elastic strip is not in tension.

12. The vest of claim 10, wherein the vest comprises three or more stretchable first webbing structures and two or more second webbing structures and wherein the stretchable first webbing structures and the second webbing structures form a grid.

13. The vest of claim 12, wherein the grid is configured to receive MOLLE gear attached to the stretchable first webbing structures.

14. The vest of claim 13, wherein the grid is configured to receive MOLLE gear attached to the second webbing structures.

15. The vest of claim 12, wherein the grid is configured to receive MOLLE gear attached to the second webbing structures.

16. The vest of claim 10, wherein at least one of said at least one second webbing structure is sewn to a respective stretchable first webbing structure of said at least two stretchable first webbing structures by stitching that extends through the webbing tube and the elastic strip of the respective stretchable first webbing structure.

17. The vest of claim 10, further comprising a handle and strap system that permits pulling of a wearer of the vest by a handle.

18. The vest of claim 10, wherein the handle and strap system comprises:

a strap anchored to the vest; and the handle, wherein the handle is located at the end of the strap;

wherein the strap and the handle are configurable between (1) a storage configuration where the handle is anchored on the vest and the strap is received in a sleeve or a pocket of the vest and (2) a deployed configuration where the handle is pulled away from the vest and the strap is at least mostly pulled out of the sleeve so as to be configured for a rescuer to pull the handle to drag a wearer of the vest.

* * * * *